United States Patent [19]

Allison

[11] 4,297,827

[45] Nov. 3, 1981

[54] APPARATUS FOR TREATING WASTE MATERIAL

[75] Inventor: William Allison, Preston, England

[73] Assignee: B. & R. Engineering Limited, Chorley, England

[21] Appl. No.: 41,971

[22] Filed: May 23, 1979

[30] Foreign Application Priority Data

May 23, 1978 [GB] United Kingdom ..... 21289/78

[51] Int. Cl.[3] ..... G21F 7/06; G21F 9/16

[52] U.S. Cl. ..... 53/282; 53/281; 141/103; 141/182; 252/301.1 W; 422/903

[58] Field of Search ..... 252/301.1 W; 422/159, 422/903; 53/281, 282; 141/103, 182

[56] References Cited

U.S. PATENT DOCUMENTS

| | | | |
|---|---|---|---|
| 3,883,441 | 5/1975 | Murphy et al. | 252/301.1 W |
| 4,056,362 | 11/1977 | Gablin et al. | 252/301.1 W |

FOREIGN PATENT DOCUMENTS

| | | | |
|---|---|---|---|
| 2421142 | 11/1975 | Fed. Rep. of Germany | 250/517 |
| 2637858 | 3/1978 | Fed. Rep. of Germany | 252/301.1 W |
| 51-12100 | 1/1976 | Japan | 252/301.1 W |
| 52-85700 | 7/1977 | Japan . | |
| 2005460 | 4/1979 | United Kingdom . | |

*Primary Examiner*—Deborah L. Kyle

*Attorney, Agent, or Firm*—Sughrue, Mion, Zinn, Macpeak and Seas

[57] ABSTRACT

A method of treating waste material, particularly radioactively contaminated waste such as ion exchange resins or molecular sieves incorporating $^{137}Cs$. The waste is one which is associated with water, e.g. the waste is wet, and is admixed with a synthetic resin composition which hardens on reaction with water. Also disclosed is an apparatus which may be used for producing the hardened waste/resin mixture in a protectively lined drum or other vessel for subsequent dumping, e.g. at sea.

15 Claims, 2 Drawing Figures

APPARATUS FOR TREATING WASTE MATERIAL

Figure 1:
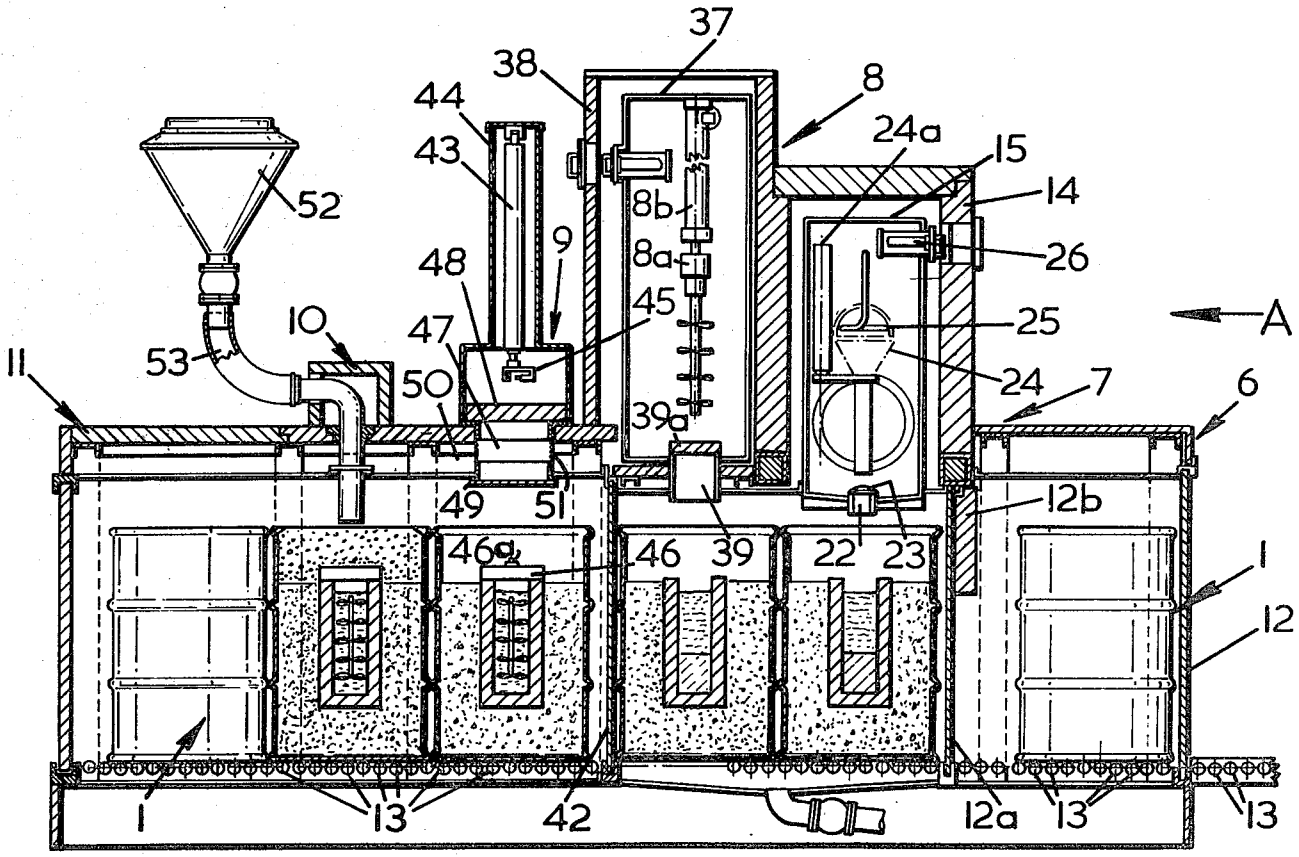

The present invention relates to a method and apparatus for the treatment of waste material particularly but not exclusively toxic waste material such as that produced in the nuclear industry.

The disposal of waste material has always been a problem and the position is particularly acute with toxic waste material which must obviously be dealt with in a manner such that it does not present a threat to the environment. Many solid waste products are in fact produced or stored under aqueous conditions and there is a need for a method which can be used for the safe treatment and disposal of such waste produces which may be associated with a substantial proportion of water even after a filtering operation. Examples of such toxic waste are certain hazardous chemicals, and irradiated waste material produced by the nuclear industry.

If the waste is radioactive then any treatment process must meet stringent requirements with regard to the radiation levels which will be emitted into the environment, and many irradiated materials must simply be stored since no process is available for their treatment and safe disposal. Since certain waste materials are continually produced in nuclear plants, there is an obvious need for a safe treatment and disposal process so as to prevent a build up of these waste products.

An example of a continually produced waste product for which no safe disposal process is available is a material which has been used for removing radioactive species from solution. A product of this category is "spent caesium resins" (a generic term used in the nuclear industry for spent organic ion-exchange resins and spent inorganic molecular sieves). These resins are a by-product from the re-processing of fuel elements, e.g. a Magnox fuel element. The elements to be re-processed are firstly stored in a pond under water and $^{137}Cs$ is released into the water as a result of the rupture of the casings of some of the elements. The active water has too high a radiation level to be passed directly into an active drain or returned to the fuel cooling pond and is therefore passed over a bed of either an ion-exchange resin (e.g. a sulphonated phenolformaldehyde resin) or a molecular sieve (e.g. an alumino silacate molecular sieve) so as to remove the $^{137}Cs$. After a time the resin (molecular sieve or ion-exchange resin) becomes "saturated" with $^{137}Cs$, i.e. the resin is spent, and cannot be used further. At present the spent caesium resin must simply be stored since no process is available for its safe disposal.

It is an object of the present invention to provide a method which may be used for treating waste material for subsequent, safe disposal.

According to a first aspect of the present invention, there is provided a method of treating waste material associated with water comprising admixing the waste material with a synthetic water hardenable resin composition, and producing a hardened mixture in which the waste material is encapsulated.

The method in accordance with the invention aims to encapsulate the waste material with a hardened matrix of a resin system, the resin system having been hardened by reaction with water associated with the waste, so that the waste is rendered more safe for disposal, i.e. it will pose less of an environmental hazard. It is envisaged that the principal use of the invention will be in the treatment of particulate or granular radioactive solid waste material, such as materials which have been used for removing radioactive ions from solution (e.g. spent caesium resins as described above).

The above described radioactive materials, e.g. spent caesium resins, have until now had to be stored since they could not be disposed of safely. The method of the invention may be used to package these wastes in concrete lined drums conventionally used in the nuclear industry, for subsequent safe disposal.

The invention also provides apparatus which may be used for packaging waste material.

The apparatus in accordance with the invention for filling protectively lined vessels, e.g. concrete lined, comprises, in succession, a vessel entry station, a filling station provided with means for supplying waste material to a vessel, a mixing station provided with means for mixing the contents of the vessel, and a capping station provided with means for filling the vessel with a protective material.

The lined vessel will generally have an inner vessel into which the waste material is to be filled and if the material is highly radioactive, it is possible to provide a lidding station between the mixing and capping stations for locating a lid, as further protection, on the inner vessel.

Apparatus for packaging radioactive waste will of course be provided with such shielding and containment as is required and a system of interlocked doors to ensure that radioactive materials are never exposed directly to the atmosphere.

The method in accordance with the invention will be described, by way of example, with reference to the treatment of wet spent caesium resins (i.e. organic ion-exchange resins or inorganic molecular sieves incorporating $^{137}Cs$).

The resin compositions used in the method of the invention are hardened by reaction with water so that admixture of the waste with the resin system will promote or accelerate hardening thereof by virtue of the water associated with the waste. The resultant product comprises waste material encapsulated in an organic matrix.

The hardenable resin system used for encapsulating the spent caesium resins must satisfy a number of criteria.

Firstly, the hardenable system must have long term stability to resist $\gamma$—radiation emitted by $^{137}Cs$ since it is obviously undesirable that the spent resin be released by breakdown of the organic matrix. In fact, the total $\gamma$ dose from an initial 312 R/hr $^{137}Cs$ source to depletion of the source is in the region of $1.18\times10^{8}$ R. In most polymers, 1 R=100 Ergs/Gramme Absorbed Energy and therefore the organic matrix is required to be able to absorb $1.18\times10^{10}$ Ergs/Gramme without degradation. Any polymer which is used in the organic resin system must have a $\gamma$—exposure dose (Ergs/Gramme) significantly above this level, e.g. by a factor of 10. Epoxy resins (with aromatic curing agent), polyurethanes and polyesters respectively have $\gamma$-exposure dose values of $1.27\times10^{11}$, $1.12\times10^{11}$ and $1.0\times10^{11}$ (Ergs/Gramme) and are therefore eminently suitable.

Secondly, the hardenable organic system must be compatible with the wet caesium resin in order that a homogeneous mixture may be produced.

Thirdly, the hardened mixture will normally be formed in a protectively lined vessel which will be dumped at sea, and the hardened system must not be degraded by the ingress of sea-water.

Fourthly, the hardenable organic system should have an exotherm below 90° C. and preferably about 70° C., so as to prevent excessive temperatures being generated during the hardening reaction causing boiling of the water entrained with the spent caesium resin.

Fifthly, the hardened mixture of caesium resin plus organic matrix must have a minimum Specific Gravity of 1.2 so as to comply with legislation for dumping nuclear products.

Water hardenable resin systems based on epoxies, polyurethanes and polyesters have been found to meet all of the above criteria, and preferred examples of these resin systems will be described below. In all cases, it is preferred that the settable resin system incorporates a filler, particularly a water hardenable filler which may be lime but which is for preference cement, e.g. Portland cement. Cement is the preferred filler material since it gives the hardened material an increased specific gravity and if desired barytes may be included to increase the specific gravity further. Conventional additives such as anti-foaming agents and viscosity depressants may be used to give the hardenable resin the required handling characteristics.

A preferred example of epoxy resin system is based on diglycidyl ethers of Bis-Phenol A and an aromatic curing agent. Such resin systems are available from Goldschmidt under the names Prodisol 42/02 and Nucleoplas 42/02. To use such a resin system, the epoxide compound is firstly blended with the required additions, e.g. cement, and with the curing agent and subsequently the spent caesium resin is added with mixing.

A preferred example of polyurethane for use in the settable resin system is an isocyanate terminated polyurethane prepolymer which crosslinks in the presence of moisture provided by the wet caesium resin. The preferred prepolymer is obtained from a polyether polyol having 2–4 hydroxyl groups per molecule by reaction of the polyol with pure MDI, the MDI also being used as a solvent.

The preferred polyols have molecular weights of 700 to 7000 and are produced from propylene oxide by initation with a polyol (glycerol or dipropylene glycol) and termination with ethylene oxide. A suitable polyurethane prepolymer is available under the designation RB 2138 from Lankro.

To perform the method of the invention, the hardenable resin system is formed by mixing the polyurethane prepolymer with poly-MDI (to provide added cross-linking), cement, anti-foaming agent and viscosity depressant. In this composition, the cement is important since it not only increases specific gravity but also acts as a dessicant to absorb water thereby preventing unwanted foaming.

A preferred, hardenable polyurethane composition produced with the above components comprises:

| | |
|---|---|
| Polyurethane Prepolymer | 30 parts by weight |
| Poly MDI | 2 parts by weight |
| Cement | 65 parts by weight |
| Cereclor (viscosity depressent) | 8 parts by weight |
| Anti-foam agent | 0.05 parts by weight |

Once the wet caesium resin, which will generally contain methylene sulphonic acid groups, is added to the above composition, cross-linking is induced so that a hardened mixture is produced. Additionally, the Poly MDI reacts—$SO_3$ groups present in the spent resin whereby the spent resin is bound more tightly in the mixture.

A further example of hardenable organic resin system in which a cross-linked polyurethane is produced on a hardening is one formed by bringing into admixture an organic polyisocyanate, a non-ionic surface active agent devoid of isocyanate-reactive groups and alkaline filler. The preferred alkaline filler is cement or lime. The organic polyisocyanate is preferably crude MDI (a mixture of di and higher functionality polyisocyantes produced by the phosgenation of the condensation product of aniline and formaldehyde). Such a composition is cross-linked by water and hence a hardening reaction is initiated on admixture of the composition with wet spent caesium resin.

The preferred polyester resin systems for use in the method of which may constitute the invention are water accelerated hardenable systems comprising unsaturated polyesters which are mixed with a peroxide and a cobalt salt so that the polyester may be cross-linked. The polyester will be used in conjunction with a cement so as to produce a polyester concrete and systems of this type are described for example in U.K. Pat. Nos. 1,292,333, 1,292,104, 1,091,325, 1,092,747 and 1,157,292 and are available under the name ESTERCRETE. Such a system will harden in the presence of water provided by the wet caesium resin.

Generally about 60% by volume of spent resin (which may be associated with up to 60% by weight water) will be mixed with about 40% by volume hardenable resin system to provide satisfactory results. Hardenable resin systems such as those described above are the preferred hardenable materials for the encapsulation of waste material in view of the fact that they may be compounded so as to begin to harden within about 15 minutes.

The hardenable resin systems, described above may if desired be used in association with a natural or synthetic a bituminous material, such as tar, pitch, bitumen and asphalt. The preferred resin system for compounding with the bituminous material is one of the above described epoxy resins, which is particularly satisfactory for producing a water compatible mixture. Such a mixture may be admixed directly with the caesium resins and quickly hardens on cooling so as to encapsulate the resin. Prior to admixture however, it is desirable to heat the container to which the bituminous product is to be added so as to allow mixing to be effected without premature setting of the bitumen.

In all of the above cases, the hardened material encapsulates the caesium resin and absorbs a certain amount of $\gamma$-radiation. Generally, the hardened composition will have been prepared in a lead vessel provided in a concrete lined drum which is subsequently capped with concrete, or possibly bitumen in the case where the hardenable material also includes a bituminous product. Further $\gamma$-radiation is absorbed by the lead and by the protective concrete (or protective bitumen) so that the radiation escaping from the drum does not exceed the value of 50 mR prescribed in safety regulations.

Figure 2:
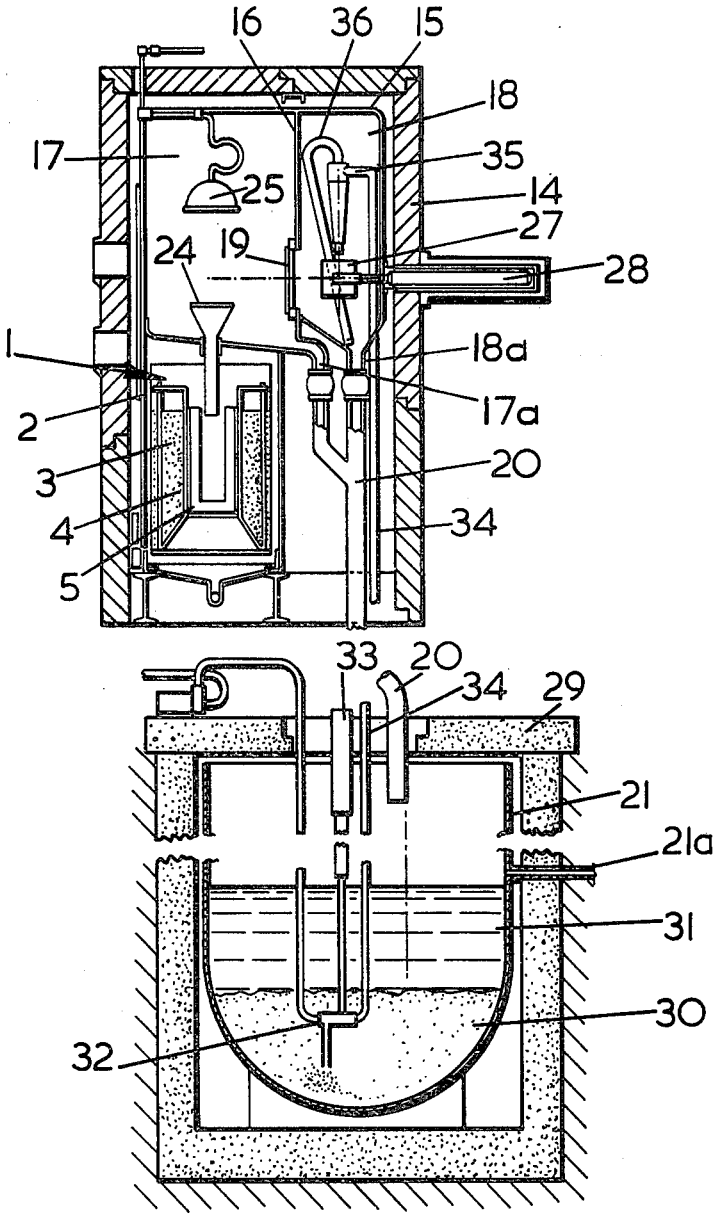

The invention as applied to the treatment of spent caesium resins, will be further described, by way of example only, with reference to the accompanying drawings, in which:

FIG. 1 shows a sectional view of one embodiment of waste packaging apparatus in accordance with the invention; and FIG. 2 is a sectional side view in the direction of arrow A of the filling station of the apparatus illustrated in FIG. 1, and showing also an associated storage tank for spent caesium resin.

The waste packaging apparatus illustrated in FIG. 1, which will be described more fully later, is used to package spent caesium resins in drums 1 for subsequent disposal. An example of such a drum 1 is clearly shown in FIG. 2 and comprises an outer steel shell (or drum proper) 2 having a concrete lining 3 within which is located a steel rod structure 4 supporting a lead vessel 5, the thickness of which will be dependant on the activity of the material to be packaged.

The waste packaging apparatus illustrated in FIG. 1, comprises a drum loading station 6, a filling station 7, a mixing station 8, a lidding station 9, a capping station 10 and a collection station 11, each of which will now be described in more detail.

The loading station 6 is a generally sealed enclosure and is provided with a hermetically sealed sliding door 12 through which drums 1 may be loaded into the enclosure by means of driven rollers 13. The loading station 6 is separated from the filling station 7 by a further hermetically sealed sliding door 12*a* which cannot be opened when door 12 is open and vice versa. The door 12*a* has an upper lead shield 12*b* for protecting the drum loading station 6 from $\gamma$-radiation.

The filling station 7 serves to introduce spent caesium resin into the interior lead vessel 5 of a drum 1. The apparatus for filling the drum is housed within relatively thick lead shielding 14 and is further enclosed within a containment box 15. A vertical partition wall 16 sub-divides the box 15 into compartments 17 and 18 which may communicate through a remotely operated door 19 provided in the wall 16. Each of the compartments 17 and 18 has a respective outlet drain 17*a* and 18*a* which runs to a common drain 20 which itself discharges into a tank 21, to be described more fully later. The compartment 17 is further provided with a basal outlet 22 having a removable cover 23.

A funnel 24 is mounted on a ram 24*a* for vertical reciprocal movement within compartment 17 between an upper position (see FIG. 1) and, when the cover 23 is removed, a lower position (see FIG. 2) in which the stem of the funnel 24 extends through the outlet 22 into a drum 1. In its upper position, the funnel 24 locates against a sparging apparatus 25. A light 26 is also provided in the chamber 17.

A mesh basket 27 of suitable capacity, eg. 5 liters, is provided in compartment 18 and is mounted on a horizontal ram 28, the arm of which may extend through the door 19 so as to locate the basket 27 above the funnel 24 when the latter is in the lowered position. The arm of the ram 28 is rotatable about its longitudinal axis through 180° so that the basket's contents may be emptied into the funnel 24.

The tank 21 housed in concrete 29, serves to store spent caesium resin 30 (under water 31) which is to be supplied to the filling station 7. To be more precise, a jet-pump arrangement 32, which is movable into and out of the resin 30 by a ram 33, supplies a mixture of water 31, and spent resin 30 via a line 34 to a hydrocyclone 35. The hydrocyclone 35 serves to separate the mixture of resin and water, the former being fed to basket 27 and the latter being removed by a waste water line 36 for subsequent return via drain 20 to tank 21. As will be clear from FIG. 2, tank 21 also receives water generated by the sparging apparatus 25 and is therefore provided with an overflow 21*a*.

Downstream of the filling station 7 is the mixing station 8 which has a low-speed high-shear stirring means 8*a* located within a container box 37 protected by lead shielding 38. The stirring means 8*a* is air-motor driven and is mounted on a ram 8*b* for vertical movement.

A basal opening 39 closed by a removable cover 39*a* is provided for the box 37 so that a sacrificial stirrer 40 may be introduced into a drum 7. The use of a sacrificial stirrer 40 is to prevent radioactive contamination of the enclosure 37 which would otherwise occur if a used stirrer were to be re-introduced into the enclosure 37. The stirrer 40 is releasably mounted on the stirring means, e.g. by a magnet, or bayonet fixing, and this operation may be performed manually with the aid of glove ports provided in the enclosure 37. A light 41 illuminates the enclosure 37 for this operation. The connection between the stirring means 8*a* and stirrer 40 will be such that it will be broken by a force of approx. 40-lbs.

Drums located at the mixing station 8 and filling station 7 may be isolated from the downstream stations by means of hermetically sealed sliding door 42.

The lidding station 9 comprises a vertical ram 43 pivotably mounted in a containment enclosure 44 and provided with a terminal latching arrangement 45 which may releasably engage an eyelet 46*a* on a lid 46. The lids 46 may be inserted in the enclosure 44 through doors (not shown) and handled therein through glove ports (not shown). The enclosure 44 has a basal opening 47 which is protected by upper and lower shields 48 and 49 respectively. Since the opening 47 extends through shielding 50, a steel sleeve 51 is provided to improve radiation containment.

The capping station 10 is provided immediately downstream of the lidding station 9 and is fed with concrete from a hopper 52 through a line 53.

Downstream of the capping station 10 is the collection station 11, from where the drum may be transferred to a drying line or drying carousel (not shown).

The method of operating the above-described apparatus for packaging spent caesium resin will now be described.

The drums 1 are supplied in the form illustrated in FIG. 2 and the lead vessel 5 is firstly partly filled with the required amount of hardenable composition, chosen in accordance with the criteria described above. The drum 1 may then be introduced into the loading station 6 through the door 12, which is subsequently closed, and the station 6 is partially evacuated to give a 2 psi water gauge reduction in pressure. Subsequently, the drum 1 may be advanced through the sliding door 12*a* to the filling station 7, after which operation the door 12*a* is closed and the pressure at the filling location is reduced to give a 3 psi water gauge reduction. There is an additional pressure reduction in enclosure 15, in which the pressure is maintained at 4 psi water gauge depression whilst the cover 23 is in position and also in containment box 37 where the pressure depression is 1 psi water gauge. This pattern of pressure reduction ensures that any air flow is toward the filling apparatus, i.e. the most contaminated portion of the apparatus, thereby avoiding unwanted contamination in other parts of the apparatus. The pressure reductions are produced by ventilation fans, (not shown), of a balancing valve arangement (not shown).

In order to charge a drum 1 with resin, the jet pump 32 is operated to supply a mixture of spent caesium resin 30 and water 31 to the hydrocyclone 35. Water 31 discharged from the hydrocyclone 35 returns to tank 21 and spent resin 30 is fed to basket 27 which holds a known quantity of resin. Any excess resin 30 supplied to basket 27 is merely returned to the tank via outlet 18*a*.

The cover 23 may then be removed from the outlet 22 and the funnel 24 moved to its lower position for filling the drum 1. The door 19 is then opened and the ram 28 extended to locate the basket 27 over the funnel 24. The resin 30 is transferred to the drum 1 by rotating the arm of the ram 28 to up-turn the basket 27 so that its contents are emptied into the funnel 24 and hence, into the drum 1. The basket 27 is then retracted back into its compartment 18 and the door 19 closed. In order to ensure a complete a complete transfer as possible of the resin 30, the funnel is reciprocated for a short period through approximately ½" prior to being raised to its upper position at which, after closure of outlet 22, it is sparged. Sparging water is passed to tank 21 via drain 20. γ-Radiation emitted by the caesium resin 30 is prevented from contaminating the loading station 6 by the shield 12*b* and the concrete 3 in the drum 1.

The drum 1 now contains a mixture of hardenable material and spent resin and is advanced to the mixing station 8. At this station, the stirrer 40 is lowered into the lead vessel through the opeing 39, after removal of the cover 39*a*, and the mixing operation effected. The stirring means 8*a* is such that it will commence to slip once the mixture begins to set and once this stage has been reached the stirring means 8*a* may be raised so that its connection with stirrer 40 is broken leaving the stirrer in the hardening mixture. The cover 39*a* is then replaced so as to cut off γ-radiation to enable an operator to mount a further stirrer 40 on the stirring means.

The filled drum 1 is next advanced through door 42 to the lidding station 9 at which a lid 46 is deposited on the lead vessel 5 by the ram 43 extending through the opening 47. Once the ram 43 has been withdrawn, the covers 48 and 49 are replaced and an operator may then swing the ram 43 to pick-up a further lid introduced into the enclosure 44 through the doors provided therein.

After the lidding operation, the drum 1, is advanced to the capping station 10 at which it is topped with a metered amount of concrete provided from hopper 52. Finally the drum 1 is advanced to the collection station 11 from where it is transferred to a lead enclosed drying line or carousel to allow substantially complete setting of the hardenable material and capping concrete. Subsequently, the drum may be examined to ensure that it does not exceed permitted radiation levels and that there are no hot-spots on the drum.

The above described apparatus is intended particularly for use in the case where the hardenable material a resin system as described above. It is however also possible to use the illustrated apparatus for encapsulating the waste material in cement or in a bituminous product, such as pitch, tar or asphalt. In the case where a bituminous product is used, heating means will be provided for heating the lead vessel 5 prior to the introduction of the bitumen to prevent premature setting thereof. Such heating means will be provided upstream of the loading station 6. Additionally, the concrete hopper may, in this case, be replaced by means for supplying bitumen for capping the drum 1.

I claim:

1. Apparatus for the packaging of waste material in a vessel having an outer drum, and an inner waste receiving chamber, and radiation shielding between the drum and the inner chamber, the apparatus comprising:

a vessel entry station having inlet and outlet doors for the transfer of vessels into and out of the vessel entry station;

a filling station downstream of the vessel entry station and having a filling position to which vessels are transferred from the entry station through the outlet door thereof, said filling station having filling means for introducing radioactive waste into said inner chamber, said filling means being provided within a filling means containment structure which may selectively communicate with, and be isolated from, the filling position, and said containment structure having external radiation shielding;

a mixing station having a mixing position to which a vessel is transferred from the filling position, said mixing station comprising mixing means provided in a mixing means containment structure the inside of which may selectively communicate with the mixing position whereby said mixing means may effect mixing of the contents of said inner container, said mixing means containment structure having external radiation shielding;

a capping station having a capping position to which a vessel is transferred from the mixing position, said capping station having means for introducing a protective capping material into said vessel, and said capping position having external radiation shielding;

means for providing a pressure differential in the apparatus such that the interior of the filling means containment structure is maintained at a lower pressure than the ambient pressure at the filling position and at the mixing position which are in turn at a lower pressure than the pressure of the interior of the mixing means containment structure whereby the flow of air in the apparatus will be toward the interior of the filling means containment structure; and means for effecting transfer of a vessel from the entry station successively to the filling position, to the mixing position and to the capping position.

2. Apparatus as claimed in claim 1 wherein a lidding station is provided between the mixing station and the capping station, the lidding station having a lidding position and lidding means for providing a lid on the inner chamber of a vessel located at the lidding position, said lidding means being provided in a lidding means containment structure which may selectively communicate with, and be isolated from, the lidding position.

3. Apparatus as claimed in claim 2 wherein the lidding means comprises a ram mounted at one end for pivotal movement in a vertical plane, and a releasable catch at the free end of the ram for releasably engaging a lid.

4. Apparatus as claimed in claim 2 wherein the selective communication between the mixing position and the interior of the mixing means containment structure is provided by removable radiation shielding.

5. Apparatus as claimed in claim 1 wherein the filling means containment structure comprises first and second compartments, with said filling position being located beneath said second compartment, said filling means comprising metering means located in said first compartment for measuring a known amount of waste material, and means located in said second compartment for allowing the transfer of the measured amount of waste material to said vessel, said metering means being movable into the second compartment to effect said transfer.

6. Apparatus as claimed in claim 5, wherein the metering means is a mesh basket.

7. Apparatus as claimed in claim 6, wherein the metering means is movable into the second compartment by means of a ram.

8. Apparatus as claimed in claim 7, wherein the arm of the ram is rotatable so as to empty the basket.

9. Apparatus as claimed in claim 5, wherein the second compartment is provided with a basal opening having a removable cover whereby the filling means containment structure may selectively communicate with said filling position, and the means for allowing the transfer of waste material to the vessel is vertically movable so as to extend through the basal opening when the cover is removed.

10. Apparatus as claimed in claim 9, wherein the means for allowing transfer of waste material to the vessel is a funnel member.

11. Apparatus as claimed in claim 5, wherein waste material is supplied to said metering means by a jet-pump.

12. Apparatus as claimed in claim 11, wherein a hydrocyclone is provided between the metering means and the jet-pump for separating liquid from the waste material.

13. Apparatus as claimed in claim 1, wherein said mixing means is capable of releasably supporting a stirrer.

14. Apparatus as claimed in claim 1 wherein the selective communication between the mixing position and the interior of the mixing means containment structure is provided by removable radiation shielding.

15. Apparatus as claimed in claim 1 wherein a hermetically sealed door is provided between the mixing position and the capping position.

* * * * *